US008783812B2

(12) United States Patent
Kagata

(10) Patent No.: US 8,783,812 B2
(45) Date of Patent: Jul. 22, 2014

(54) PRINTING APPARATUS AND PRINTING METHOD

(71) Applicant: Seiko Epson Corporation, Tokyo (JP)

(72) Inventor: Takayoshi Kagata, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 46 days.

(21) Appl. No.: 13/658,434

(22) Filed: Oct. 23, 2012

(65) Prior Publication Data

US 2013/0100188 A1 Apr. 25, 2013

(30) Foreign Application Priority Data

Oct. 25, 2011 (JP) ..... 2011-234235
Nov. 1, 2011 (JP) ..... 2011-240432

(51) Int. Cl.

| | |
|---|---|
| ***B41J 2/205*** | (2006.01) |
| ***B41J 2/01*** | (2006.01) |
| ***B41M 5/00*** | (2006.01) |
| ***B41J 2/21*** | (2006.01) |

(52) U.S. Cl.

CPC ..... *B41J 2/2103* (2013.01); *B41M 5/0023* (2013.01)
USPC ..... 347/15; 347/101

(58) Field of Classification Search

USPC ..... 347/14, 15, 41, 43, 101
See application file for complete search history.

(56) References Cited

U.S. PATENT DOCUMENTS

| | | | | |
|---|---|---|---|---|
| 6,869,174 | B2 * | 3/2005 | Faken | 347/101 |
| 7,682,015 | B2 * | 3/2010 | Hoshino | 347/102 |
| 8,419,177 | B2 * | 4/2013 | Ozawa | 347/100 |
| 8,444,243 | B2 * | 5/2013 | Kakutani | 347/15 |
| 2002/0135652 | A1 | 9/2002 | Matsuhashi et al. | |
| 2009/0244168 | A1 | 10/2009 | Kakutani | |
| 2011/0267395 | A1 | 11/2011 | Kakutani | |

FOREIGN PATENT DOCUMENTS

| | | |
|---|---|---|
| JP | 2002-254896 | 9/2002 |
| JP | 2003-245600 | 9/2003 |
| JP | 2008-200895 | 9/2008 |
| JP | 2009-233877 | 10/2009 |
| JP | 2010-52226 | 3/2010 |

* cited by examiner

*Primary Examiner* — Anh T. N. Vo
(74) *Attorney, Agent, or Firm* — Workman Nydegger

(57) ABSTRACT

A printing apparatus includes a nozzle that ejects brilliant ink to a medium to form a brilliant image, a nozzle that ejects color ink to the medium to form a color image, and a control unit that ejects the color ink after ejecting the brilliant ink to the medium, applies, to the color image, a pattern in which blocks each having a predetermined area and each formed of pixels with the same gradation are arranged, and ejects the color ink so that the color image after the application is formed.

10 Claims, 7 Drawing Sheets

PRINTING APPARATUS AND PRINTING METHOD

The entire disclosure of Japanese Patent Application Nos. 2011-234235, filed Oct. 25, 2011, 2011-240432, filed Nov. 1, 2011 are expressly incorporated by reference herein.

BACKGROUND

1. Technical Field

The present invention relates to a printing apparatus and a printing method.

2. Related Art

When performing printing on a medium, there is a case in which a printing having special color development is performed using metallic ink or the like. In printings having the special color development, a printing having an impression of a distinctive metallic brightness, which is a so-called "lamé", may be included. A lamé-tone printing may be referred to as a printing having an impression of brightness in which reflectance is different for each location thereof.

In JP-A-2008-200895, a card having a laméprinting layer is shown. In JP-A-2003-245600, a color sheet for a brilliant coating is shown. In JP-A-2002-254896, a method of forming an image using a printing medium and a transfer sheet film is shown. In JP-A-2010-52226, a printing having a predetermined texture performed by masking ejection of color ink is shown. In JP-A-2009-233877, changing dot density of the metallic ink is shown.

When the lamé-tone printing can be performed by performing an ink jet printing for performing a printing by ejecting ink, it is convenient to create different lamé-tone impression for each region. In this manner, when the different lamé-tone impressions for each region are realized, there is a case in which a printed matter having more lamé-tone impression is desired.

SUMMARY

An advantage of some aspects of the invention is that a printing having more lamé-tone impression may be performed.

According to an aspect of the invention, there is provided a printing apparatus including: a nozzle that ejects brilliant ink to a medium to form a brilliant image; a nozzle that ejects color ink to the medium to form a color image; and a control unit that ejects the color ink after ejecting the brilliant ink to the medium, applies, to the color image, a pattern in which blocks each having a predetermined area and each formed of pixels with the same gradation are arranged, and ejects the color ink so that the color image after the application is formed.

Other features of the invention will become apparent from descriptions of the present specification and the accompanying drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
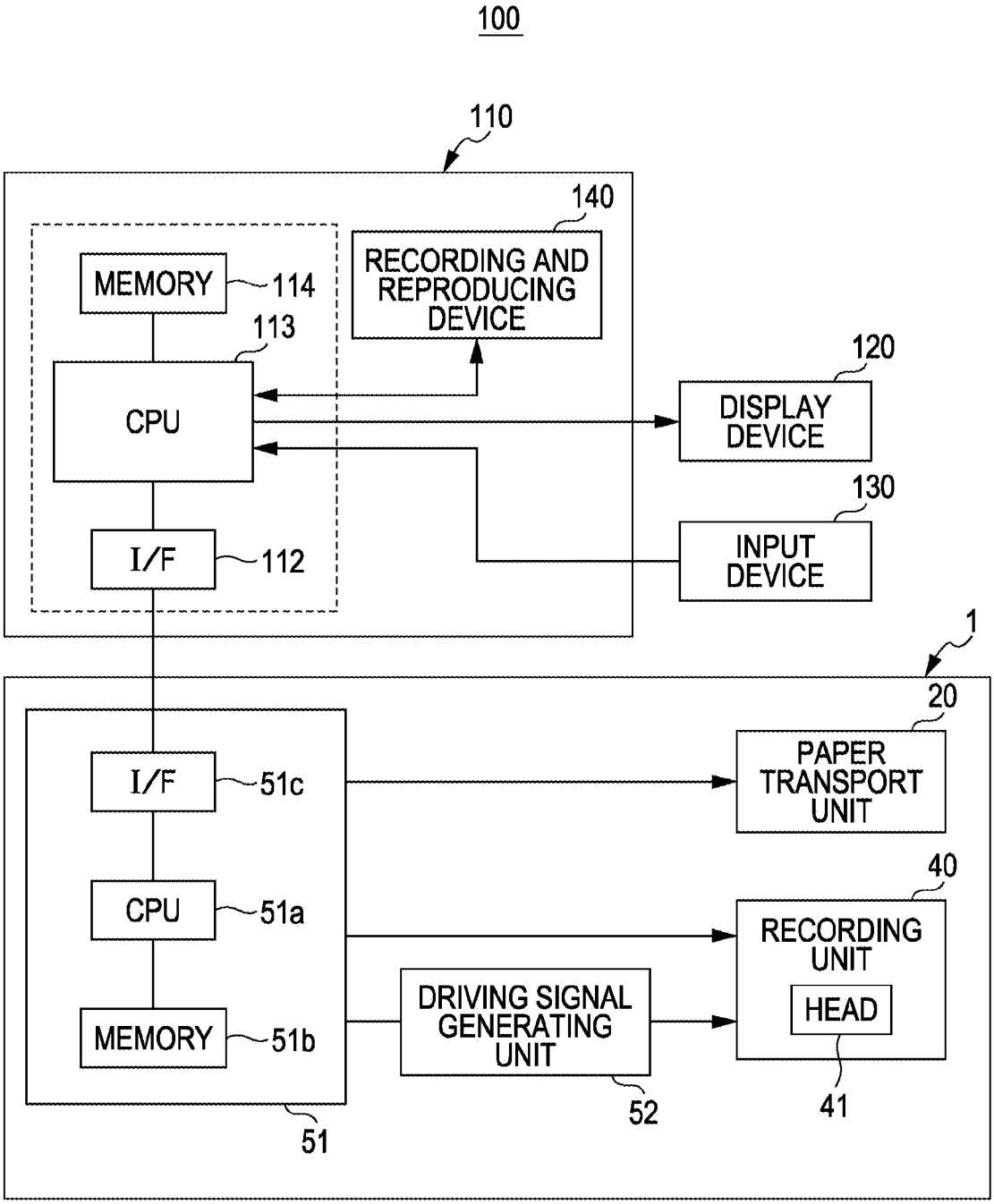
FIG. 1 is a block diagram showing a printing system according to an embodiment of the invention.

At least the following will be apparent by the descriptions of the present specification and the accompanying drawings. That is, the invention relates to a printing apparatus that includes a nozzle that ejects brilliant ink to a medium to form a brilliant image, a nozzle that ejects color ink to the medium to form a color image, and a control unit that ejects the color ink after ejecting the brilliant ink to the medium, applies, to the color image, a pattern in which blocks each having a predetermined area and each formed of pixels with the same gradation are arranged, and ejects the color ink so that the color image after the application is formed.

In this manner, the pattern of the blocks is applied by the color image formed on an image by the brilliant ink, and therefore a printing having more lamé-tone impression may be performed.

In the printing apparatus, it is preferable that a size of the block having the predetermined area be changed in a fixed range for each block.

In this manner, the size of the block is made random, and therefore it is possible to perform a printing having a more lamé-tone impression.

In addition, it is preferable that the blocks be irregularly arranged.

In this manner, the blocks are irregularly arranged, and therefore it is possible to perform a printing having a more lamé-tone impression.

In addition, it is preferable that the pattern be not applied to an image having a smaller area than the predetermined area.

When the pattern is applied to an image smaller than the blocks of the pattern, there is a case in which only the density of the image itself is changed and the lamé-tone printing is not performed, but it is possible to avoid the above-described problem by doing this.

In addition, it is preferable that the control unit applies, to the brilliant image, the pattern in which blocks each having a predetermined area which are formed of pixels with the same gradation are arranged, and ejects the brilliant ink so that the brilliant image obtained after the application is formed.

In this manner, since the lamé-tone printing may be performed even by the brilliant ink, it is possible to perform a printing for creating a more lamé-tone.

In addition, it is preferable that the pattern applied to the color image and the pattern applied to the brilliant image be different from each other.

In this manner, the blocks are dispersed by preventing the same pattern from being overlapped in the color image and the brilliant image, and therefore it is possible to perform an appropriate lamé-tone printing.

In addition, it is preferable that at least one of rotational movement, parallel movement, and inversion of a density which are performed on one pattern of the pattern applied to the color image and the pattern applied to the brilliant image be applied to the other pattern.

In this manner, the blocks are dispersed by making the pattern applied to the color image and the pattern applied to the brilliant image different, and therefore it is possible to perform an appropriate lamé-tone printing.

In addition, at least the following will be apparent by the descriptions of the present specification and the accompanying drawings. That is, the invention relates to a printing method that includes applying, to a color image, a pattern in which blocks each having a predetermined area which are formed of pixels with the same gradation are arranged to thereby form the color image after the application, ejecting color ink to a medium to form the color image after the application, and ejecting brilliant ink to the medium to form a brilliant image.

In this manner, the pattern of the block is applied by the color image formed on the brilliant ink, and therefore a lamé-tone printing having more luminosity may be performed.

EMBODIMENTS

FIG. 1 is a block diagram showing a printing system 100 according to an embodiment of the invention. Hereinafter, a schematic configuration of the printing system 100 according to the present embodiment will be described with reference to FIG. 1.

The printing system 100 includes an ink jet printer 1 (hereinafter, may simply referred to as a "printer 1") as a printing apparatus, a computer 110, a display device 120, and an input device 130. The printer 1 prints an image on a medium such as paper, fabric, film, or the like. The computer 110 is communicably connected to the printer 1 through an interface 112. Since an image is printed to the printer 1, the computer 110 outputs printing data corresponding to the image to the printer 1. The computer 110 includes a CPU 113, a memory 114, an interface 112, and a recording and reproducing device 140. A computer program such as an application program or a printer driver is installed. The recording and reproducing device 140 is, for example, a floppy disk drive device or a CD-ROM drive device.

The display device 120 is, for example, a liquid crystal monitor. The display device 120 is used to display, for example, a user interface of a computer program. The input device 130 is, for example, a keyboard or a mouse.

The ink jet printer 1 includes a paper transport unit 20, a recording unit 40, a control unit 51, and a driving signal generating unit 52. The paper transport unit 20 supplies a medium such as paper S from a rolled paper R to the recording unit 40, and discharges the paper S after printing. The recording unit 40 moves a carriage 43 on which a head 41 is mounted, and ejects ink from the head 41 to thereby form an image on the medium, as will be described below.

In addition, the ink jet printer 1 includes the control unit 51 for controlling overall operations of each component described above. The control unit 51 includes a CPU 51*a* for performing an operation or the like, a memory 51*b* for storing a program, an operation result, or the like, and an interface 51*c* for performing communication with an external device. The control unit 51 controls the paper transport unit 20, the recording unit 40, and the driving signal generating circuit 52.

The driving signal generating unit 52 supplies a driving signal COM to each piezoelectric element (PZT, which will be described below) of the head 41 of the recording unit 40. Digital data for regulating a shape of a driving signal is transmitted from the control unit 51 to the driving signal generating unit 52, so that the driving signal COM that is a voltage waveform is generated based on the digital data.

Figure 2:
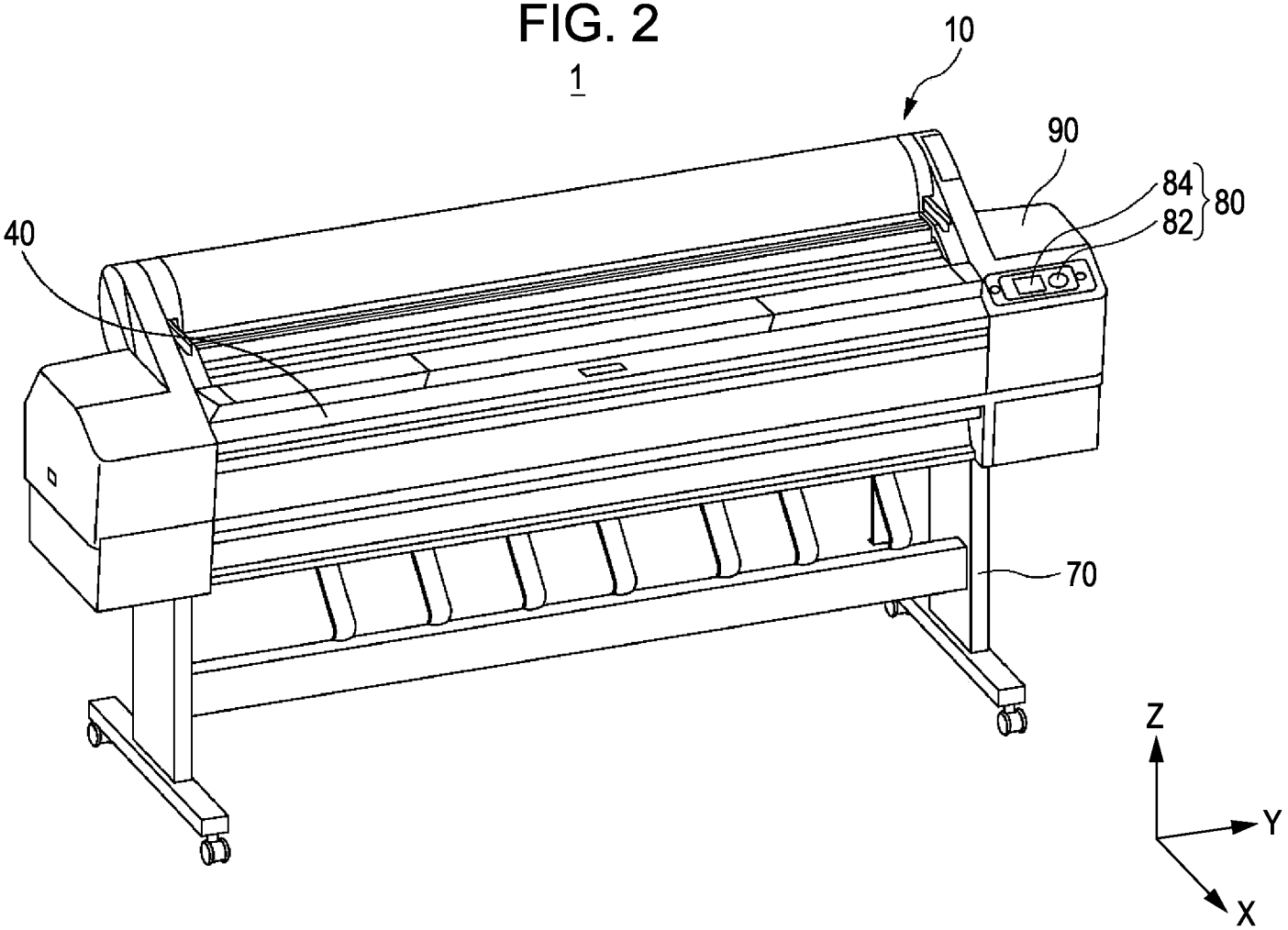
FIG. 2 is a perspective view showing an ink jet printer according to an embodiment of the invention.
Figure 3:
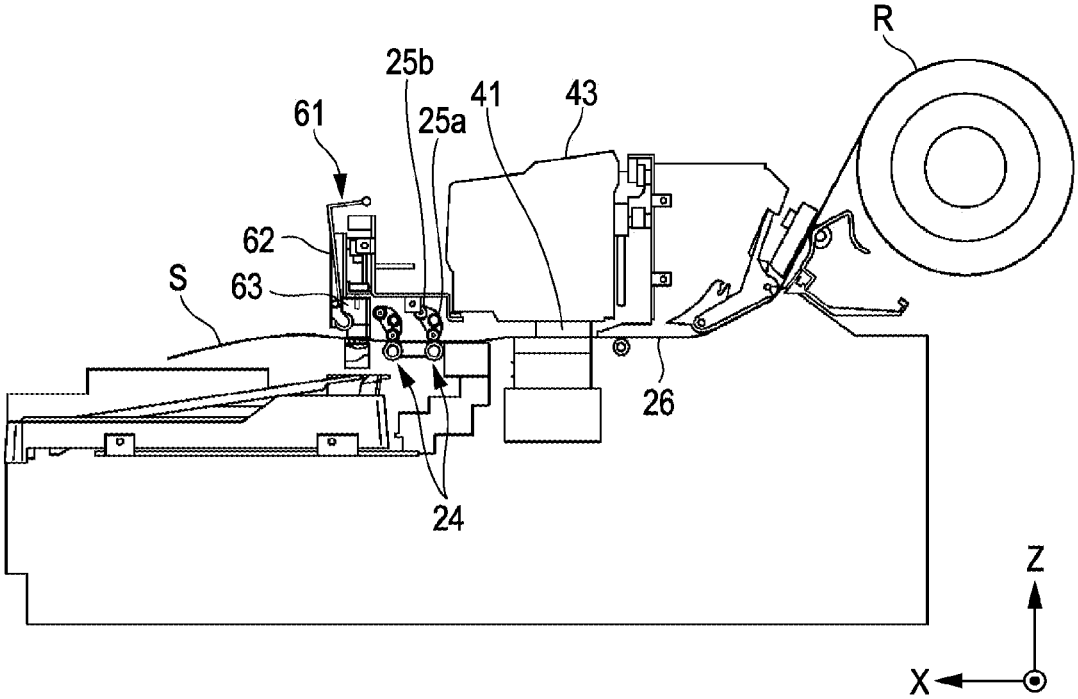
FIG. 3 is an internal side view showing an ink jet printer according to an embodiment of the invention.

FIG. 2 is a perspective view showing an ink jet printer 1 according to an embodiment of the invention, and FIG. 3 is an internal side view showing an ink jet printer 1 according to an embodiment of the invention. In the following description, a transport direction (a discharge direction) of a medium may be referred to as an X-axis direction, a width direction (a vertical direction on a page in FIG. 3) of a transport path 26 perpendicular to the X-axis direction may be referred to as a Y-axis direction, and a vertical direction perpendicular to the X-axis direction and the Y-axis direction may be referred to as a Z-axis direction.

As shown in FIG. 2, the ink jet printer 1 includes the recording unit 40 whose longitudinal direction is disposed horizontally, a housing 90 that is mounted on an end portion of the recording unit 40, a loading portion 10 that is loaded on an upper side of the recording unit 40, and a leg portion 70 that supports the recording unit 40 and the housing 90 from below.

The recording unit 40 includes the head 41 for ejecting ink to a medium that is transported along the transport path 26. The head 41 is mounted on the carriage 43 that is freely moved in the width direction of a transport path 14. An ink cartridge (not shown) for storing ink is mounted on the carriage 43. The head 41 includes a plurality of nozzle rows, and ejects ink of each of the predetermined colors (for example, yellow (Y), magenta (M), cyan (C), black (K), clear (Cl), metallic (Me)) from the plurality of nozzle rows. The head 41 may perform image formation for recording information such as predetermined images, characters, or the like by ejecting ink to a recording surface of a medium.

The medium on which the image formation is performed in the recording unit 40 is discharged from a discharge roller 24. The discharge roller 24 has a mechanism for converting a roller for nipping into a giza roller 25*a* or a roll roller 25*b* according to the kind of paper.

On a downstream side of the discharge roller 24, a cutter device 61 for cutting the discharged medium into a predetermined size is provided. The cutter device 61 includes a regulating member 62 for regulating a height position of the discharged medium and a cutter unit 63 that is moved in the width direction (Y-axis direction) perpendicular to a discharge direction (X-axis direction) of the medium so as to cut the medium.

An operation panel 80 is disposed on an upper surface of the housing 90. The operation panel 80 includes a display unit 84 for displaying an operational state of the printer 1 in addition to a plurality of switches 82 which are operated by a user. Accordingly, the user operates the printer 1 from a front surface side using a side where the operation panel 80 and a cartridge holder are disposed, as the front surface side.

Figure 4:
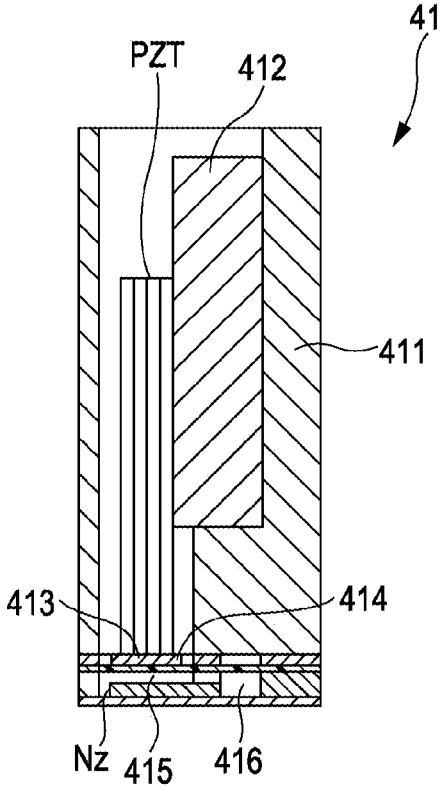
FIG. 4 is a cross-sectional view showing a structure of a head.

FIG. 4 is a cross-sectional view showing a structure of a head 41. A flow passage 416 is formed in the head 41, and ink is supplied through the flow passage 416. An adhesive substrate 412 is fixed to a case 411 of the head 41. The adhesive substrate 412 is a rectangular plate, and a piezoelectric element (PZT) is adhered to one surface of the adhesive substrate 412. An island portion 413 is joined to a distal end of the piezoelectric element (PZT), and an elastic region is formed around the island portion 413 by an elastic film 414.

The piezoelectric element (PZT) is deformed by applying a potential difference between electrodes facing each other. In this example, the piezoelectric element (PZT) is expanded and contracted in the longitudinal direction thereof. An amount of the expansion and contraction is determined according to a potential of the piezoelectric element (PZT). When the piezoelectric element (PZT) is expanded or contracted, the island portion 413 is pushed to a pressure chamber 415 or drawn in the opposite direction. In this instance, since the elastic film 414 in the vicinity of the island portion is deformed, ink may be efficiently ejected from a nozzle Nz.

By adopting the configuration described above, ink having a plurality of sizes may be ejected by adjusting amplitude of a driving signal applied to the piezoelectric element (PZT). In the present embodiment, small dots, medium dots, and large dots may be formed.

Figure 5:
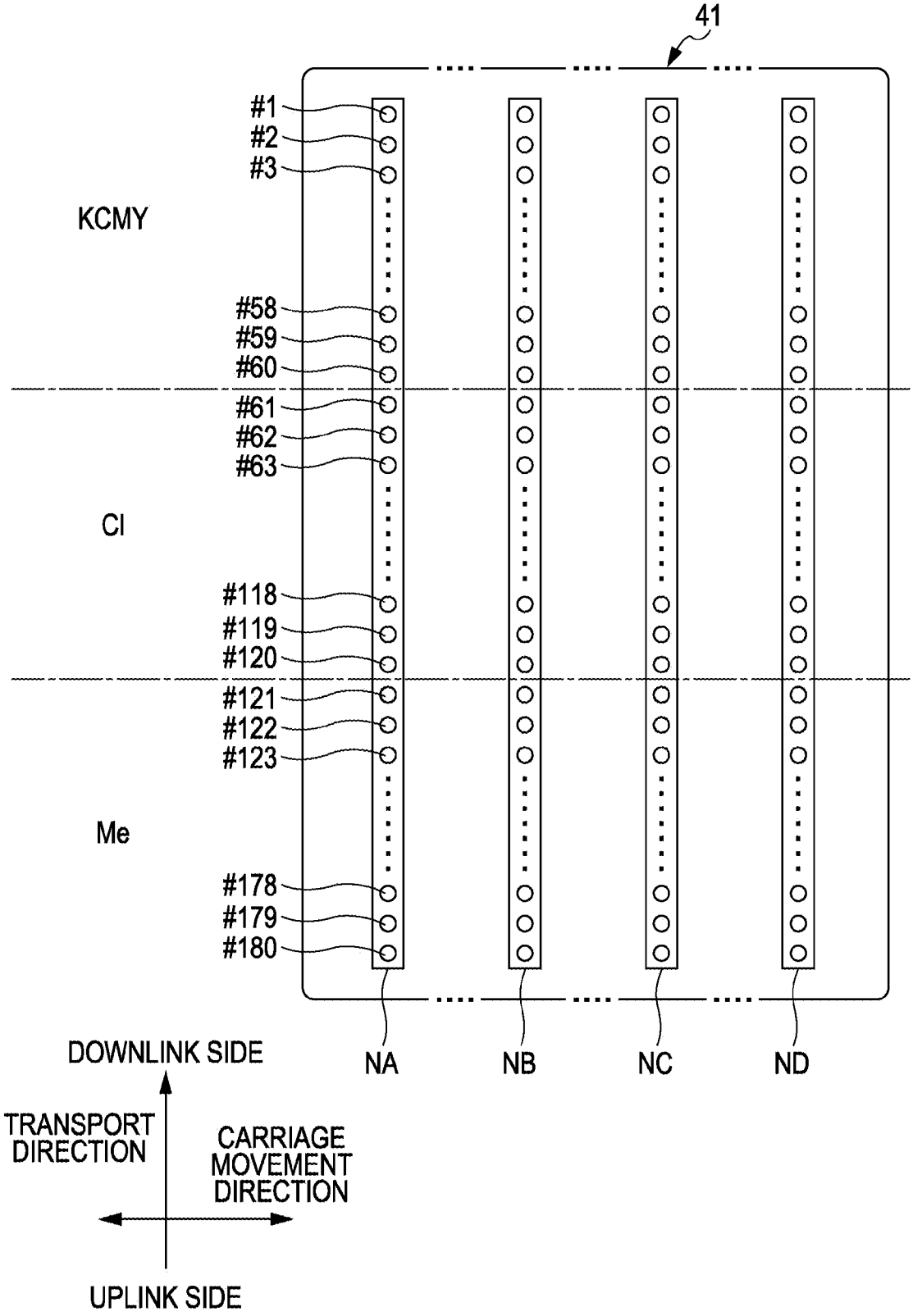
FIG. 5 is an explanatory diagram showing nozzles of a head.

FIG. 5 is an explanatory diagram showing nozzles of the head 41. Six kinds of ink such as yellow ink (Y), magenta ink (M), cyan ink (C), black ink (K), clear ink (Cl), and metallic ink (Me) may be ejected from the head 41 according to the present embodiment.

The clear ink (Cl) is generally colorless and transparent ink opposed to colored ink. Here, the clear ink (Cl) is not limited to colorless and transparent ink, and may widely refer to colored and transparent ink or ink which is difficult to detect by a variety of sensors such as a reflective optical sensor and the like when printed on the medium S even though the clear ink (Cl) is colored and non-transparent ink.

The metallic ink (Me) contains a metallic pigment and an organic solvent. The metallic pigment is not particularly limited as long as it has metallic gloss or the like, but it is desirable that aluminum or an aluminum alloy, or silver or a silver alloy may be used. Among these, in terms of costs and achievement of high metallic gloss, aluminum or an aluminum alloy is preferably used. When the aluminum alloy is used, other metal elements or nonmetallic elements to be added to aluminum are not particularly limited as long as they have metallic gloss or the like. Here, silver, gold, platinum, nickel, chromium, tin, zinc, indium, titanium, copper, etc. may be used, and at least one of a single metal, an alloy of them, and a mixture of them may be appropriately used. In the present embodiment, silver is used as the metallic pigment. In addition, metallic ink is included in brilliant ink. In the metallic ink, the contained pigment is not limited to the metallic pigment described above, and any pigments may be used as long as they have metallic gloss.

In the drawings, four nozzle rows are shown. Among these nozzles, a nozzle on a downstream side ejects color ink. A nozzle on an upstream side ejects metallic ink (Me). A nozzle in the middle ejects clear ink (Cl).

Specifically, nozzles #1 to 460 of A nozzle row NA eject black ink (K). Nozzles #61 to #120 of A nozzle row NA eject clear ink (Cl). Nozzles #121 to #180 of A nozzle row NA eject metallic ink (Me).

In the same manner, nozzles #1 to #60 of B nozzle row NB eject cyan ink (C). Nozzles #61 to #120 of B nozzle row NB eject clear ink (Cl). Nozzles #121 to #180 of B nozzle row NB eject metallic ink (Me).

In the same manner, nozzles #1 to #60 of C nozzle row NC eject magenta ink (M). Nozzles #61 to #120 of C nozzle row NC eject clear ink (Cl). Nozzles #121 to #180 of C nozzle row NC eject metallic ink (Me).

In the same manner, nozzles #1 to #60 of D nozzle row ND eject yellow ink (Y). Nozzles #61 to #120 of D nozzle row ND eject clear ink (Cl). Nozzles #121 to #180 of D nozzle row ND eject metallic ink (Me).

By adopting the configuration described above, at least the metallic ink (Me) is ejected to the medium, the clear ink (Cl) is ejected thereon, and then color ink is ejected thereon.

Figure 6:
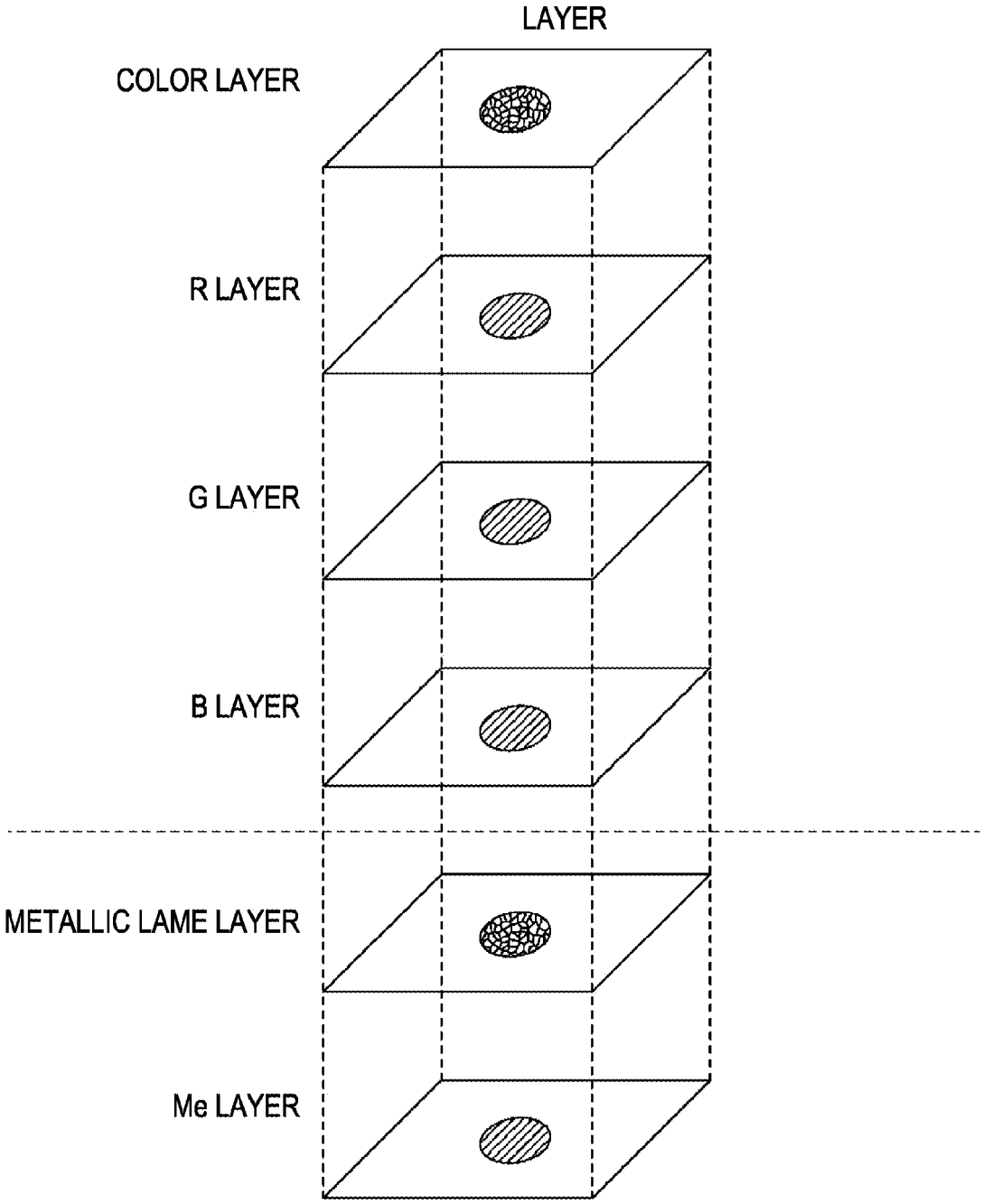
FIG. 6 is an explanatory diagram showing a layer of a formed image according to an embodiment of the present invention.

FIG. 6 is an explanatory diagram showing a layer of a formed image according to an embodiment of the present invention. In the present embodiment, in order to perform a lamé-tone printing, an image is created from a plurality of layers shown in FIG. 6. First, like a typical image, a color image is created by a layer of red R, a layer of green G, and a layer of blue B. A single color image may be obtained by overlapping these three primary color layers.

In addition, an image indicating which region that the lamé-tone printing is applied to of the color image is created as a color lamé-layer. The image is an image by a random pattern which will be described below. The random pattern will be described below.

In addition, in the present embodiment, a metallic layer is provided, and the metallic ink ejected to the region is regulated by the image on the metallic layer. In addition, a metallic lamé-layer is provided, and an image indicating that the lamé-tone printing is applied to the portion of the region to which the metallic ink is ejected is created. This image is also an image by a random pattern which will be described below. The random pattern will be described below.

Figure 7C:
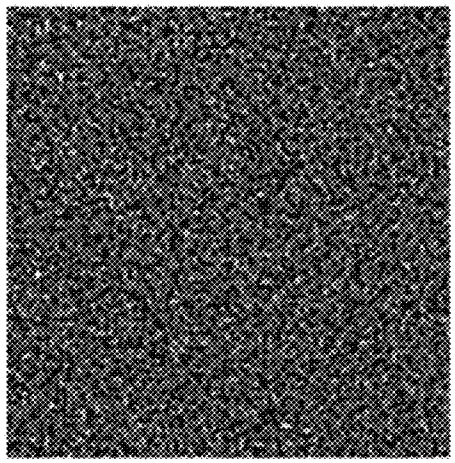
FIGS. 7A to 7C are drawings showing a random pattern used in a lamé-tone printing according to an embodiment of the invention.
Figure 7B:
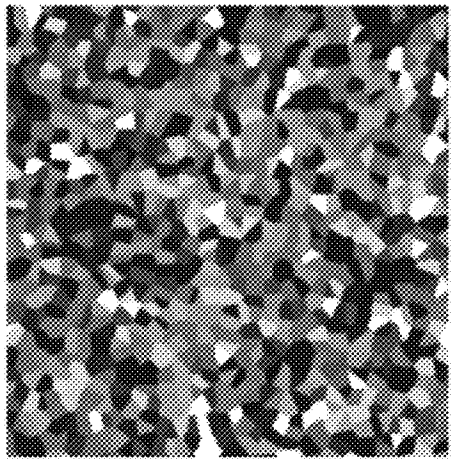
Figure 7A:
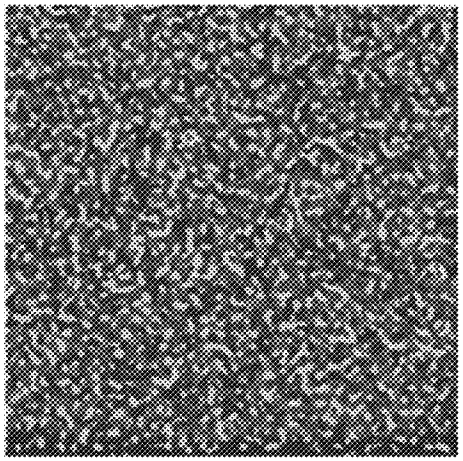

FIGS. 7A to 7C are drawings showing a random pattern used in a lamé-tone printing according to an embodiment of the invention. In the present embodiment, a pattern shown in FIGS. 7A to 7C is referred to as a random pattern. The random pattern is a pattern in which a plurality of block-like pieces are irregularly arranged. Each block is a block having a predetermined area, which is formed of a plurality of pixels having the same gradation value. As for these blocks, the blocks having exactly the same size are not arranged, and the sizes of the blocks are changed within a fixed range for each block and shapes of the blocks are different for each block. In addition, each of the blocks has a different gradation value. An average size of the blocks may be arbitrarily changed. For example, a pattern in which blocks having a size shown in FIG. 7A are arranged may be formed, a pattern in which blocks having a coarser size shown in FIG. 7B are arranged may be formed, or a pattern in which blocks having a finer size shown in FIG. 7C are arranged may be formed.

In these drawings, a large amount of ink is ejected to portions displayed as black, and a small amount of ink is ejected to portions displayed as white. For example, in layers of a color lamé-pattern, when each pixel is expressed by 256 gradations (values being "0" to "255"), the color ink is not ejected when white, that is, at the gradation value of "0" (ink ejection duty 0%). In addition, the largest amount of the color ink is ejected when black, that is, at the gradation value of "255" (ink ejection duty 100%).

The size of the block may be specified for each image of a color lamé-layer and each image of a metallic lamé-layer. In addition, a larger block may be adopted along with an increase in a lamé-tone region occupying an area of a medium.

In addition, it is preferable that a random pattern (a random pattern of the metallic image) used in the metallic lamé-layer and a random pattern (a random pattern of the color image) used in the color lamé-layer be different from each other. In this case, the random pattern for the color image may be rotatably moved to thereby be used as the random pattern for the metallic image. In addition, the random pattern for the color image may be moved in parallel to thereby be used as the random pattern for the metallic image. In addition, the density of the random pattern for the color image may be inverted to thereby be used as the random pattern for the metallic image. In addition, by a combination of them, the density of the random pattern for the color image may be inverted to thereby be used as the random pattern for the metallic image.

In addition, in order to prevent a base from being exposed, it is preferable that a minimum density value (a density of the most white portion) of pixels of the random pattern for the metallic image be a duty 10% (the gradation value being "25"). In particular, it is preferable that a duty of each pixel of the random pattern for the metallic image be about 30% to 70%. In addition, when a size of an image piece in the color image is smaller than a size of a block of the random pattern for the color image, the random pattern for the color image may not be applied to the image piece. This is because, when the random pattern is applied to the image piece, the lamé-tone printing may not be performed only by a change in the density of the image piece.

Figure 8:
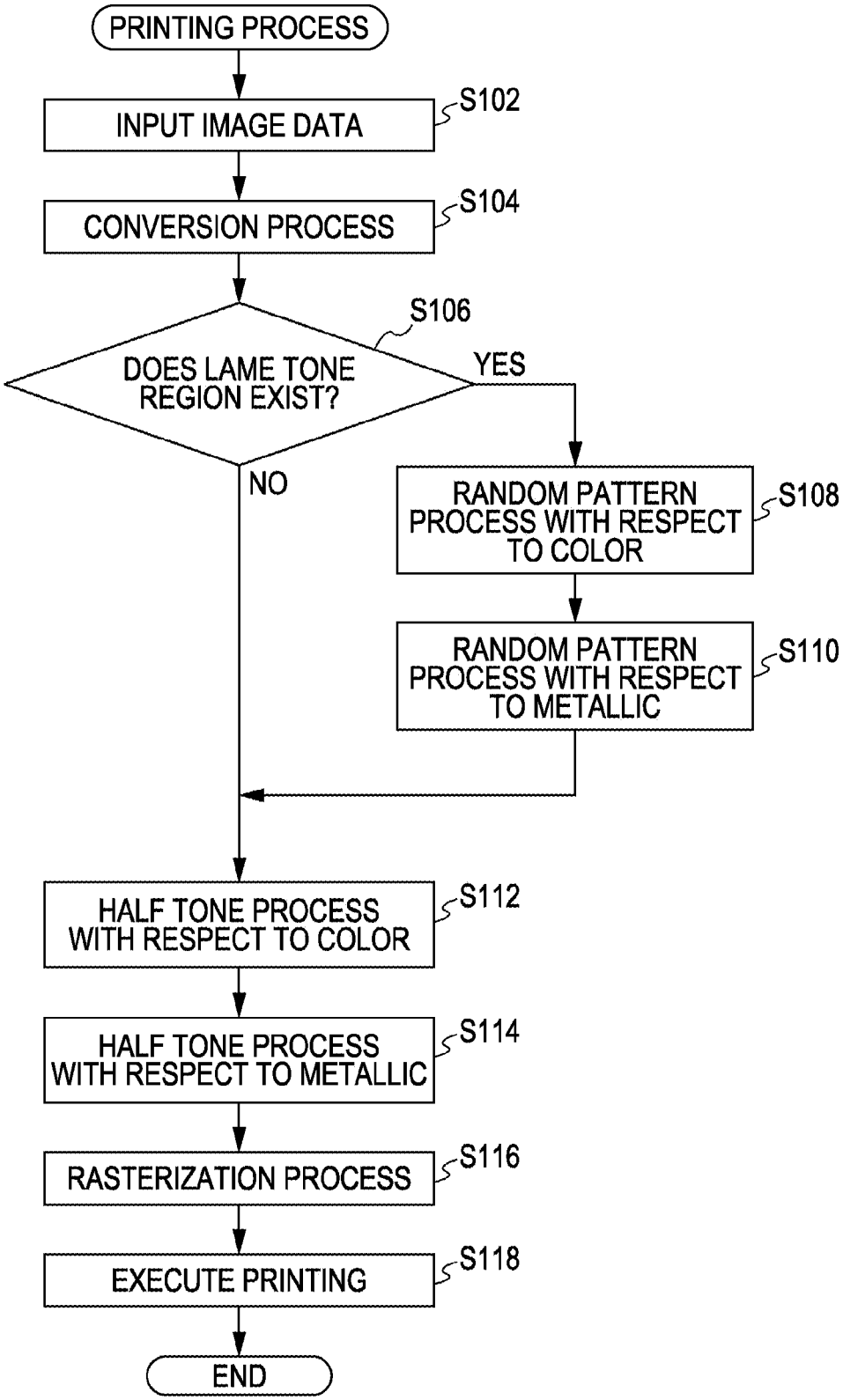
FIG. 8 is a flowchart showing a lamé-tone printing according to an embodiment of the invention.

FIG. 8 is a flowchart showing a lamé-tone printing according to an embodiment of the invention. Hereinafter, the lamé-tone printing according to the present embodiment will be described with reference to the flowchart.

First, in step S102, image data is input. The input of the image data is carried out by creating an image via image software capable of handling layers on the computer 110. The input image is an image formed of a plurality of layers as shown in FIG. 6 described above.

Next, in step S104, a conversion process of the input image data is performed. The conversion process of the image data is performed in the printer driver installed in the computer 110. In the conversion process of the image data, a resolution conversion process and a color conversion process are performed. The resolution conversion process is a process in which an image of each layer is converted into an image having a resolution at the time of printing. The color conversion process is a process in which each pixel data of each layer of KGB of the color image is converted into image data of a CMYK color space. That is, by the present conversion process, a red (R) layer, a green (G) layer, and a blue (B) layer may be converted into a red (R) layer, a green (G) layer, a blue (B) layer, a cyan layer, a magenta layer, a yellow layer, and a black layer.

Next, in step S106, determination as to whether a region where the lamé-tone printing is performed is present is carried out. The determination as to whether the region where the lamé-tone printing is performed is present is carried out by referring to the image data in the color lamé-layer and the metallic lamé-layer. When the region where the lamé-tone printing is performed is designated in the color lamé-layer or the metallic lamé-layer, step S108 is performed. Meanwhile, when the region where the lamé-tone printing is performed is not designated, step S112 is performed.

In step S108, a random pattern process is performed with respect to the color image. The random pattern process performed with respect to the color image is performed in such a manner that the color lamé-layer is superimposed on each of a cyan layer, a magenta layer, a yellow layer, and a black layer. The superimposition is performed by multiplying a gradation value of each pixel of a CMYK layer by a gradation value of a pixel of the same position in the color lamé-layer as a duty value.

For example, when a gradation value of yellow in a given pixel is "200", and a gradation value of a block of the same pixel on the color lamé-layer is "127" (duty being 50%), the gradation value of yellow in this pixel becomes "100" (=200×50%). Such an operation is performed with respect to each pixel of a yellow layer, a magenta layer, a cyan layer, a black layer. Therefore, a yellow layer, a magenta layer, a cyan layer, and a black layer which correspond to a random pattern of a color lamé-pattern layer may be generated. The invention is characterized in that the random pattern for the lamé-tone printing is applied to the color image.

In addition, when a region where the lamé-tone printing is performed is designated even on the metallic lamé-layer, the random pattern process 5110 is performed with respect to the metallic image. In the random pattern process with respect to the metallic image, a metallic lamé-pattern layer is superimposed on the metallic layer. The superimposition is performed by multiplying a gradation value of each pixel of the metallic layer by a gradation value of a pixel of the same position in the metallic lamé-layer as a duty value.

As for an image in the metallic (Me) layer, a gradation value in a region where the image is formed is generally "255" (this image is opposed to the fact that the color image is formed by a plurality of gradation values, but obviously, may be formed by the plurality of gradation values, like the color image). Accordingly, when a gradation value of metallic in any image is "255", and a gradation value of a block of the same pixel in the metallic lamé-layer is "127" (duty is 50%), a gradation value of metallic in this pixel becomes "127" (int (255×50%)). Such an operation is performed for each pixel to thereby generate a metallic layer.

Next, in step S112, a half-tone process is performed with respect to the color image. The half-tone process is a process in which CMYK pixel data is converted into a small level of gradation data that can be displayed by the printer 1. By the half-tone process, the CMYK pixel data indicating, for example, 256 gradations is converted into data indicating gradation values of four levels (large dots, medium dots, small dots, and no dot). This process is performed with respect to each of a cyan layer, a magenta layer, a yellow layer, and a black layer, the CMYK pixel data is converted into data indicating the gradation value for each ink color.

Next, in step S114, the half-tone process is performed with respect to the metallic image. By the half-tone process, the pixel data of the metallic image indicating 256 gradations is converted into data indicating four level of gradation values.

By the above-described process, that dots with which size are formed in which pixel is determined with respect to each of cyan ink (C), magenta ink (M), yellow ink (Y), black ink (K), and metallic ink (Me).

Next, in step S116, a rasterization process is performed. The rasterization process is a process in which dot data obtained by the half-tone process is changed to have the order of data that is to be transported to the printer 1. Next, in step S118, the printer 1 performs a printing based on data obtained after the rasterization process.

Therefore, the random pattern of the block may be applied by the color image formed on the image of the metallic ink, and therefore it is possible to perform a printing having a more lamé-tone impression.

Case of Applying LaméOnly for Color Ink

In the above-described embodiments, the lamé-tone printing is performed by applying the random pattern for the color ink and the metallic ink, but the lamé-tone printing may be performed by applying the random pattern only for the color ink. In this case, the metallic lamé-layer of FIG. 6 is not created, and the random pattern process is not performed with respect to the metallic image of step S110 in FIG. 8.

Case of Applying Pattern Even for Clear Ink

The lamé-tone printing is performed by applying the random pattern for the color ink and the metallic ink, but may be further performed by applying the random pattern even for the clear ink. Consequently, in addition to two layers of the color lamé-pattern and the metallic lamé-pattern of FIG. 6, a clear lamé-layer and a clear layer are added. Next, in FIG. 8, step S111 is added, so that the random pattern process is performed with respect to the clear, and step S115 is added, so that the half-tone process is performed with respect to the clear. In addition, on the clear layer, an image in which clear ink is uniformly ejected to all pixels is defined.

Therefore, a printing capable of creating a more lamé-tone impression may be performed.

Other Embodiments

In the above-described embodiments, the printer 1 as the printing apparatus has been described, but the invention is not limited thereto, and may be implemented in a liquid discharging device that can eject or discharge other fluids (a liquid, a liquid material in which a functional material is dispersed, or a fluid such as gel) other than ink. The technology according to the above-described embodiments may be applied to a variety of devices to which the ink jet technologies are applied, such as a color filter manufacturing device, a dyeing device, a fine processing device, a semiconductor manufacturing device, a surface processing device, a three-dimensional molding machine, a gas vaporizer, an organic EL manufacturing device (particularly, a high molecular EL manufacturing device), a display manufacturing device, a film forming device, a DNA chip manufacturing device, and the like. In addition, the method and the manufacturing method which are described above may be in the range of the applications.

The above embodiments are intended to facilitate the understanding of the invention and are not intended to be construed as limiting the invention. It should be noted that the invention may be modified and improved, and include the equivalents thereof without departing from the scope and spirit of the invention.

Head

In the above-described embodiments, ink is discharged using the piezoelectric element. However, a method of discharging a liquid is not limited thereto. For example, other methods such as a method of generating bubbles within the nozzle by heat, and the like may be used.

What is claimed is:

1. A printing apparatus comprising:

a nozzle that ejects brilliant ink to a medium to form a brilliant image;

a nozzle that ejects color ink to the medium to form a color image; and a control unit that controls the nozzles for ejecting the color ink after ejecting the brilliant ink to the medium, and applies, to the color image, a lame-tone pattern in which blocks each having a predetermined area and each formed of pixels with the same gradation are arranged.

2. The printing apparatus according to claim 1, wherein a size of the block having the predetermined area is changed in a fixed range for each block.

3. The printing apparatus according to claim 1, wherein the blocks are irregularly arranged.

4. The printing apparatus according to claim 1, wherein the pattern is not applied to an image having a smaller area than the predetermined area.

5. The printing apparatus according to claim 1, wherein the control unit applies, to the brilliant image, the pattern in which blocks each having a predetermined area and each formed of pixels with the same gradation are arranged, and ejects the brilliant ink so that the brilliant image obtained after the applying is formed.

6. The printing apparatus according to claim 5, wherein the pattern applied to the color image and the pattern applied to the brilliant image are different from each other.

7. The printing apparatus according to claim 5, wherein at least one of rotational movement, parallel movement, and inversion of a density which are performed on one pattern of the pattern applied to the color image and the pattern applied to the brilliant image is applied to the other pattern.

8. The printing apparatus according to claim 1, further comprising:

a nozzle that ejects clear ink to the medium to form the brilliant image, wherein the control unit controls the nozzles for ejecting the clear ink after ejecting the color ink, and applies, to the clear image, the pattern in which blocks each having a predetermined area and each formed of pixels with the same gradation are arranged.

9. The printing apparatus according to claim 1, wherein the nozzle that ejects brilliant ink is located upstream in a transport direction of the medium of the nozzle that ejects color ink on a nozzle row.

10. A printing method, comprising the steps of:

applying, to a color image, a lamé-tone pattern in which blocks each having a predetermined area and each formed of pixels with the same gradation are arranged thereby to form the color image after the step of applying;

ejecting color ink to a medium to form the color image after the step of applying; and ejecting brilliant ink to the medium to form a brilliant image.

* * * * *